United States Patent [19]

Hazleton

[11] 4,001,752

[45] Jan. 4, 1977

[54] CALIBRATING ADJUSTMENT OF THERMOSTAT

[75] Inventor: Herbert T. Hazleton, Brandon, Manitoba, Canada

[73] Assignee: Federal Pioneer Electric Limited, Toronto, Canada

[22] Filed: July 11, 1975

[21] Appl. No.: 595,220

[30] Foreign Application Priority Data

Nov. 18, 1974 Canada ..... 213923

[52] U.S. Cl. ..... 337/368; 337/57; 337/82

[51] Int. Cl.[2] ..... H01H 37/20

[58] Field of Search ..... 337/94, 112, 57, 64, 337/67, 82, 365, 368, 372, 380

[56] References Cited

UNITED STATES PATENTS

| | | | |
|---|---|---|---|
| 2,798,131 | 7/1957 | Collier | 337/67 |
| 3,423,713 | 1/1969 | Levinn | 337/365 |
| 3,670,284 | 6/1972 | Fortier | 337/380 |

*Primary Examiner*—Harold Broome

[57] ABSTRACT

A thermostat includes a base plate supporting a switch and an ambient temperature sensing bimetal that actuates the switch. A set-point adjusting cam cooperates with the bimetal. An internally threaded bushing is supported upright on the base plate and is frictionally locked against rotation. The set-point adjusting cam is supported on a threaded shaft which screws into the bushing. The bushing is rotatable for fine calibration of the thermostat, while the threaded shaft is screwed into the bushing through an appropriate number of turns for coarse calibration.

9 Claims, 5 Drawing Figures

FIG. 1
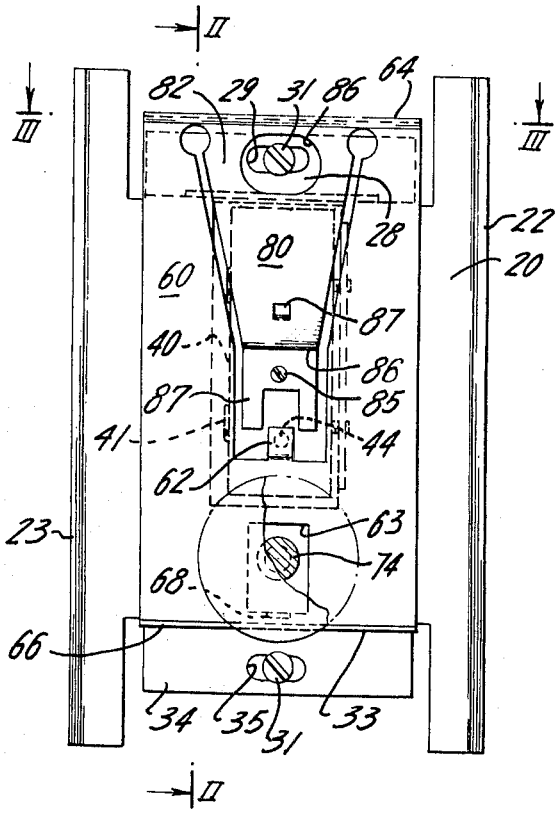
FIG. 2
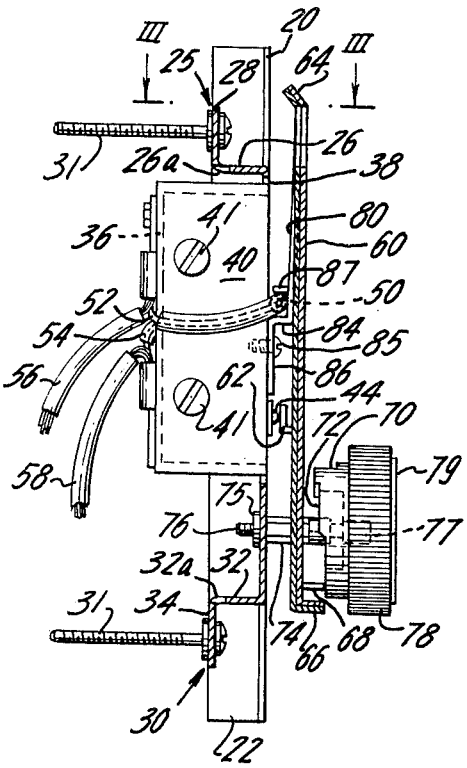
FIG. 3
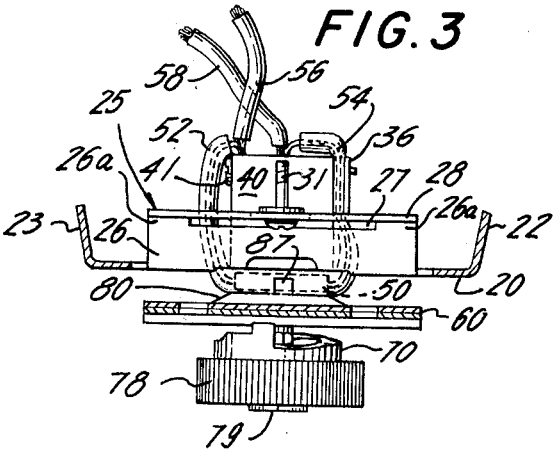
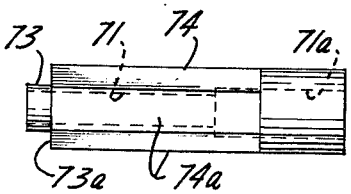
FIG. 4
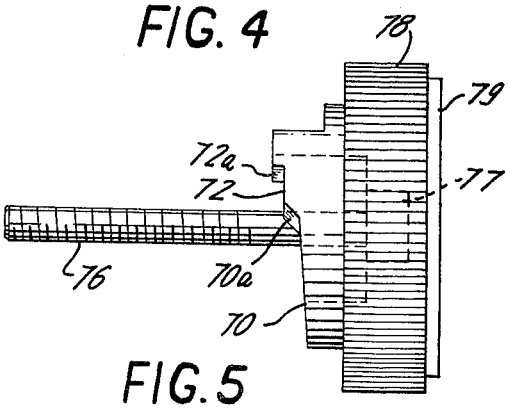
FIG. 5

CALIBRATING ADJUSTMENT OF THERMOSTAT

BACKGROUND OF THE INVENTION

This invention relates to thermostats for electric heating or cooling apparatus. The invention is discussed in connection with so-called line voltage thermostats, wherein the load current required by an electric heater or a room air conditioner is carried by the switch that forms part of the thermostat, but it applies equally to other thermostats of similar construction.

One type of line voltage thermostat includes an ambient temperature sensing bimetal formed of an elongated sheet or plate of sufficient width for rigidity. The bimetal is pivotally mounted near one end from a base plate and is oriented vertically when mounted on a wall of a room. An adjustment screw is screwed into a tapped hole in the mid section of the bimetal from the front, and the end of the screw bears against the spring-loaded plunger of a snap-switch. A rotatable cam bears against the bimetal element near the other end in opposition to the force exerted against the adjustment screw in the bimetal by the plunger and the spring of the switch.

The set-point temperature is determined by the rotational position of the cam of the thermostat and the thermostat is calibrated by turning the adjustment or calibration screw into or out of the bimetal element with the screw engaging against the plunger of the switch. It is usually desired to calibrate the thermostat so that the switch will be actuated when a pointer on the cam or on a knob affixed to it points upright or to a "normal" position when the temperature rises to approximately 70° F. The adjustment of the calibrating screw is usually performed by the manufacturer and then locked or cemented against further rotation. More broadly stated, known thermostats generally include a temperature sensor, a set-point adjusting cam and a separate calibrating screw.

SUMMARY OF THE INVENTION

It is an object of this invention to provide means to calibrate thermostats using a novel support for the set-point adjusting cam. This eliminates the need for a separate calibration screw, and avoids the related requirement of aligning the screw with the plunger of the switch of the thermostat. It also minimizes the possibility of the calibration being disturbed by tampering since the usual cemeted-in-place calibration screw is eliminated.

Accordingly, this invention provides thermostats which may be calibrated by means of an adjustment in the mounting of the set-point adjustment cam. A switch is controlled by the ambient temperature sensor and both are carried by a main support. The cam has a lateral cam surface for determining the position of a cam follower coupled to the sensor to adjust the set-point of the thermostat.

The cam is mounted on a main support by means of a pair of threaded members, one being threaded into the other. A first threaded member is supported upright from the main support, restrained against axial motion and frictionally locked against rotation. The second threaded member forms an integral part of the set-point adjusting cam. The cam bearing member is rotated through an appropriate number of turns for establishing coarse calibration of the thermostat. In this operation, the first and second threaded members are screwed into assembly with one another. The first member is then rotated relative to the main support for providing fine calibration of the thermostat. An advantage of this arrangement for calibrating thermostats is that it eliminates various manufacturing problems and expense associated with the use of a separate calibrating screw. Another advantage of this arrangement is that it reduces the likelihood of users tampering with the calibration of the unit since the means of adjusting the calibration is not readily apparent because no calibrating screw head appears in the unit.

DESCRIPTION OF THE DRAWINGS

FIG. 1 is a front view of a thermostat embodying features of the invention, with the cover removed and the adjusting knob represented by dotted lines;

FIGS. 2 and 3 are side and top sectional views of the thermostat of FIG. 1, viewed from planes II—II and III—III therein;

FIG. 4 is a detail drawing of the cam-supporting bushing of the thermostat of FIGS. 1–3; and FIG. 5 is a detail drawing of the adjustment cam and supporting shaft of the illustrated thermostat.

Other features and advantages of the invention will become clear from the accompanying drawing when considered together with the following detailed description of the preferred embodiment.

DESCRIPTION OF THE PREFERRED EMBODIMENT

In the drawings of FIGS. 1–3, the preferred embodiment of the novel thermostat includes a base plate 20 that is formed economically of sheet metal. Alternatively, the base plate can be formed as a casting or as a molded plastic part. Base plate 20 has integral side walls 22 and 23 formed at an angle therefrom and a support member 25 which includes a wall 26 perpendicular to the front of the base plate and which supports a strip 28 which is parallel to the front. An elongated slot 27 is formed between strip 28 and wall 26 of the support member leaving narrow support legs **26*a* at the ends of strip 28, perpendicular to the plane of strip 28. A smaller elongated slot 29 is provided in strip 28 for receiving a screw 31 or other fastener. Likewise, a bottom support member 30 for the base plate includes a perpendicular wall 32 and a parallel support strip 34 having an elongated slot 33 at their junction, leaving narrow support legs 30*a* at the ends of strip 34, perpendicular to the plane of strip 34. A shorter elongated slot 35 is provided in strip 34 for receiving a screw 31. Strips 28 and 34 provide a supporting structure for the switch mounting plate 20** that has distinctive advantages, and is the subject of a companion patent application Ser. No. 595,222.

Base plate 20 also has a vertical support plate 36 perpendicular to the front and adjacent a rectangular opening 38 in the base plate for receiving a switch 40 having an enclosure attached to plate 36 by bolts 41. Switch 40 has an actuating plunger 44 extending from the front thereof and is of the snap-switch type requiring only limited travel of the plunger for causing snap-switch actuation of the switching mechanism between open and closed, and between closed and open positions.

A small heating resistor 50 is disposed across the front of switch housing 40 and is connected across the switch terminals by conductors 52 and 54 which connect with line conductors 56 and 58, respectively, for a power input terminal and a load terminal of the device.

A main bimetal element 60 is disposed parallel to base plate 20 and has an integral foot 62 offset from the rear surface thereof for engaging plunger 44 to actuate the snap-switch 40. Main bimetal 60 is the ambient temperature sensing element and is formed of an elongated sheet of bimetal having ends 64 and 66 and an integral upwardly turned post 68 near end 66 for engaging the surface of a cam 70 for adjustment of the set-point of the thermostat. The switch actuator 44 provides spring bias urging the bimetal to the right in FIG. 2, and biases post 68 against cam 70. Cam 70 includes a ridge 72 for positive actuation of the switch to hold the switch open regardless of the ambient temperature. Cam 70 is supported from base plate 20 by an internally threaded bushing 74. The end of bushing 74 is reduced in diameter, passed through base plate 20 and spun over at the rear to provide a fastening means 75 to restrain axial movement thereof and to frictionally lock it against rotation. Fastening means 75 also secures bushing 74 against tilting motion. A knob 78 having a pointer 79 is connected to the front of cam 70, for rotating the cam. The knob and cam are carried by a threaded shaft 76 extending through the bushing, providing for rotation of the cam and the knob. The advantages of internally threaded bushing 74 and threaded shaft 76 of the cam are more fully disclosed and claimed in an application Ser. No. 595,222 filed concurrently herewith by H. T. Hazleton.

A compensating tongue 80 of bimetal is cut from bimetal sheet 60 or formed integral therewith and has its high expansion metal facing in the same direction as main bimetal 60. The end 64 of ambient temperature sensing bimetal 60 is unitary with and carried by base 82 of compensating tongue 80 as a cantilever. The projecting end 86 of the compensating tongue extends toward the opposite end of bimetal 60, is fixed to switch 40 by screw 85 and contacts auxiliary heating resistor 50 for the maximum deflection of the tongue by both switch heat and by the resistor heat. Projecting end 86 includes a portion 84 adjacent resistor 50, bent approximately at right angles to the rest of the compensating bimetal tongue, adjacent resistor 50. A tab 87 is cut from compensating tongue 80 and bent down against auxiliary resistor 50 to improve the heat coupling of the compensating tongue to resistor 50 and for mechanical retention of the resistor. The close proximity of the compensating tongue 80 to switch 40 and the exposure of a large portion of its area to the switch and its attachment thereto closely heat-couples the compensating tongue to the switch. This thermal coupling is much closer than the incidental exposure of a small part of the distant ambient sensing bimetal 60 to switch heat. Since the high expansion sides of the compensating bimetal tongue 80 and the ambient sensing bimetal 60 face in the same direction, they bow or warp in the same direction, but act differentially on the switch since they are joined in mechanical series at the base of the tongue. The compensating tongue is also exposed to the ambient atmosphere and main bimetal 60 should, therefore, be substantially longer than the compensator to provide adequate response to ambient temperature changes.

Heat generated in switch 40 by current conduction tends to increase the bow or deflection of main bimetal 60 and thereby causes switch plunger 44 to be depressed and open the switch at an ambient temperature below the set-point. Bimetal tongue 80 raises or lowers the cantilevered end 64 of main bimetal 60 inwardly or outwardly responsive to the amount of heat generated in switch 40 to compensate for the effect of switch heat on the main bimetal. Compensating tongue 80 raises cantilevered end 64 of main bimetal 60 as the switch conducts for longer periods on a cold day and generates more heat within itself, which ensures that the ambient temperature in the room is maintained at the set-point.

The thermostat of FIGS. 1–3 is constructed to be mounted in an upright position with base 82 of bimetal tongue 80 at the top so that most of the bimetal tongue is located above the body of switch 40. In this orientation, convection currents of air entering at the bottom and heated by switch 40 will rise along the surfaces of bimetal tongue 80 for the best heat-coupling between the switch and the compensating bimetal tongue. A cover (not shown) having ventillating openings in the top and bottom engages the base plate for protectively enclosing the thermostat against the wall and allowing the convection of air through it from the room.

The supporting structure for the set-point adjusting cam of the thermostat is best illustrated in FIGS. 2, 4 and 5. An elongated, internally threaded bushing 74 forming a support member for the cam is supported upright from the front surface of base plate 20. Bushing 74 is formed of a cylindrical body having flats 74*a* formed along at least a portion of its length as shown in FIG. 4. An axial internally threaded passage 71 is formed through the body and an enlarged axial opening 71*a* is formed in the front portion of the bushing in alignment with passage 71. An end portion 73 of reduced diameter is formed on the body which provides a supporting shoulder 73*a* near the rear end of the bushing.

As shown in FIG. 2, the reduced end 73 of the bushing 74 is inserted into an opening 21 in base plate 20 until the shoulder 73*a* of the bushing rests against the front of the base plate. The rear end 73 of the bushing is then swaged or rolled over to form a fastening means 75 which restrains axial movement of the bushing and frictionally locks it against rotation. Fastening means 75 and shoulder 73*a* also hold bushing 74 in an upright position and prevents it from tilting with respect to the base plate.

As seen in FIG. 5, set-point adjusting cam 70 is a hollow cylindrical element in which the cam surface extends around the rear face of the cylinder and includes an inclined surface 70*a* and on adjacent ridge 72 for positive actuation of the thermostat switch. A stop 72*a* is provided to prevent rotation of the cam beyond the desired adjustment range of the thermostat.

The front end of the cylindrical cam 70 is affixed to a knob 78 having a pointer 79. A threaded shaft 76 forming a second threaded member has an enlarged portion 77 which is recessed into cylindrical cam 70 and knob 78 in axial alignment with them. The proportions of the axial openings in bushing 74 are such that threaded shaft 76 of cam 70 freely slides into axial opening 71*a* and screws into internally threaded passage 71 in the bushing. The assembly of the threaded members and the cam with the base plate forms the manipulating portions of the thermostat.

With reference to FIG. 2, the threaded shaft 76 supporting cam 70 is screwed into the bushing 74 until the cam surface urges the bimetal element 60 and its foot 62 into actuating range for switch 40. In this procedure, force is applied near the end 66 of the bimetal element to deflect it toward the base plate to allow the cam to be rotated several times so that it screws into actuating range for switch plunger 44 for coarse calibration of the thermostat. The bimetal is released and cam 70 is then rotated to a predetermined temperature setting of the pointer 79. The bushing is rotated by a tool which engages the flats on the bushing to adjust the axial position of the cam and its threaded shaft 76 for fine calibration of the thermostat. The rotation of bushing 74 adjusts the axial position of the threaded shaft 76 of the cam since its internal threads engage with the threads on the shaft of the cam.

In use of the thermostat, cam 70 is rotated to select a desired set-point. The shape of the lateral cam surface is one factor in determining the position of the cam follower, supplemented by the effect of the threaded members in shifting the cam axially. If the thread were very coarse, conceivably the cam surface would be flat or approximately flat, but in practice the cam surface has a definite slope.

What we claim is:

1. A thermostat having a main support, an ambient temperature sensor, a switch controlled by the ambient temperature sensor, said switch and ambient temperature sensor being carried by the main support, and cam means for establishing the set-point of the thermostat and including a cam follower coupled to the sensor and a cam member having a lateral cam surface for determining the position of the cam follower to adjust the set-point of the thermostat, and a support member rotatable about an axis and supported upright from the base plate and restrained from axial movement, said cam member and said support member having cooperating male and female threaded portions affording relative rotation therebetween for causing displacement of the cam upon rotation of the support member.

2. A thermostat as in claim 1, wherein said cam follower is carried by the ambient temperature sensor and the support member bears an accessible manipulating portion.

3. A thermostat as in claim 1, wherein said threaded portions include a screw supporting the cam and an internally threaded passage in the support member for receiving the screw of the cam.

4. A thermostat as in claim 1, wherein the ambient temperature sensor comprises a bimetal element and the switch is a snap-switch.

5. A thermostat as in claim 1, wherein said cam member is rotatable about an axis for displacing the cam follower essentially parallel thereto to adjust the set-point of the thermostat and the support member is rotatable about the axis of the cam.

6. An apparatus having a main support, actuating means, and a switch controlled by the actuating means, said switch and actuating means being carried by the main support, cam means for establishing a bias on switch actuation and comprising a cam follower coupled to the switch and rotatable about an axis and having a lateral cam surface for displacing the cam follower essentially parallel to the axis of the cam, a support member rotatable about the axis of the cam and supported upright from the main support and restrained from axial movement, said cam member and said support member having cooperating male and female threaded portions affording relative rotation therebetween for causing axial displacement of the cam upon rotation of the support member.

7. Apparatus as in claim 6, wherein said cam follower is carried by the actuating means and the support member bears an accessible manipulating portion.

8. Apparatus as in claim 6, wherein said threaded portions includes a screw supporting the cam and an internally threaded passage in the support member for receiving the screw of the cam.

9. Apparatus as in claim 6, wherein said actuating means comprises an ambient temperature sensor and the switch is a snap-switch.

* * * * *